United States Patent [19]

Cox

[11] 4,026,233

[45] May 31, 1977

[54] PROTECTIVE HULL SAFETY COVER

[76] Inventor: Michael A. Cox, 4335 Palm Ave., West Palm Beach, Fla. 33406

[22] Filed: May 4, 1976

[21] Appl. No.: 683,029

[52] U.S. Cl. ..... 114/229
[51] Int. Cl.[2] ..... B63B 43/16
[58] Field of Search ..... 114/45, 221 R, 222, 114/227–229

[56] References Cited

UNITED STATES PATENTS

| | | | |
|---|---|---|---|
| 623,961 | 4/1899 | Quimby | 114/222 |
| 1,070,260 | 8/1913 | Jameson | 114/229 |
| 3,142,283 | 7/1964 | Fisher | 114/222 |
| 3,685,477 | 8/1972 | Wood | 114/222 |

FOREIGN PATENTS OR APPLICATIONS

| | | | |
|---|---|---|---|
| 1,094,883 | 12/1967 | United Kingdom | 114/222 |

*Primary Examiner*—Trygve M. Blix
*Assistant Examiner*—Jesus D. Sotelo

[57] ABSTRACT

A portable, safety hull cover for a marine vessel or the like which may be quickly deployed from a vessel which has sustained hull damage that destroys the water-tight integrity of the hull which could cause the vessel to flood and ultimately sink. The saftety cover is a flexible, waterproof sheet of material sized and shaped for attachably conforming to the vessel bow, sides and keel, with the cover being readily connected to the bow by an attaching noose and deployed against the hull along the outside bottom of the vessel. The safety cover when deployed will prevent water from being received into the boat through a damaged hull section as long as the boat or vessel is moving, such as would be the case with the vessel trying to reach a safe harbor. The device has an auxiliary use to form an enclosure around the boat for cleaning the hull.

3 Claims, 7 Drawing Figures

Fig. 2.
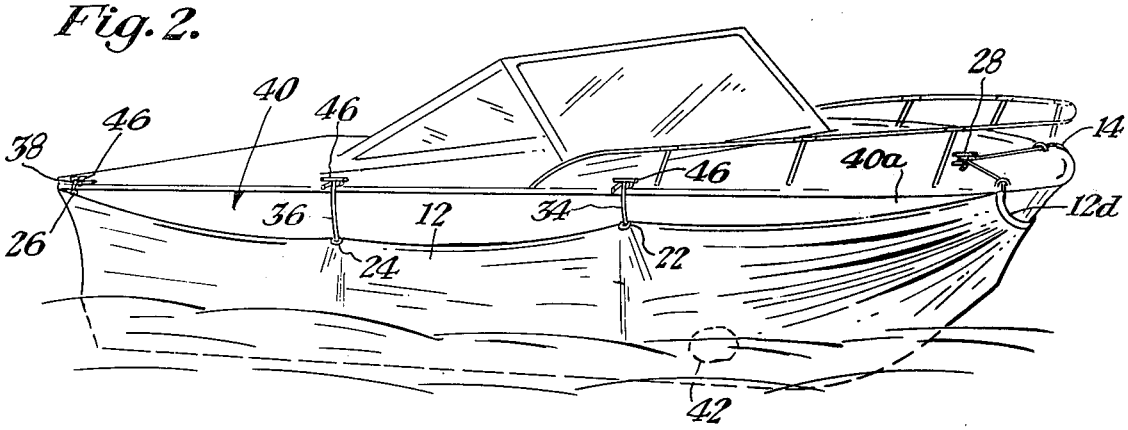
Fig. 6
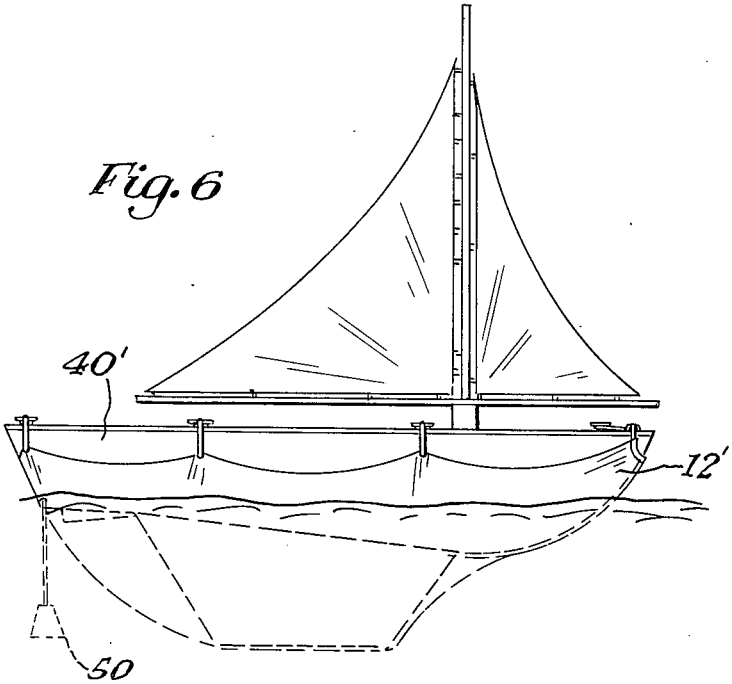
Fig. 4.
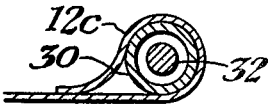
Fig. 3.
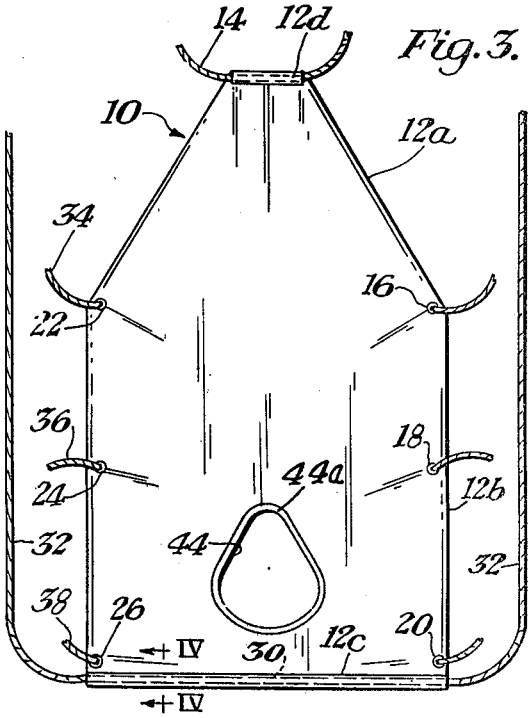
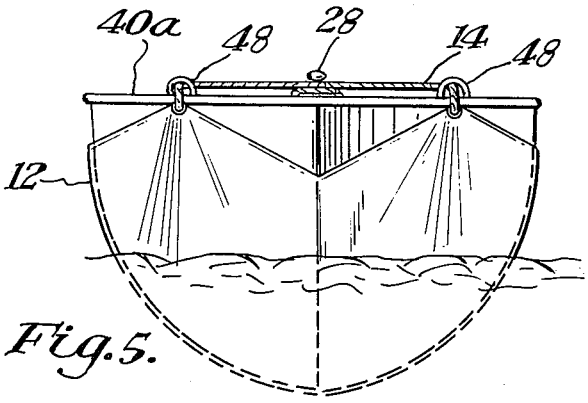
Fig. 5.

PROTECTIVE HULL SAFETY COVER

BACKGROUND OF THE INVENTION

This invention relates generally to a safety device which may be employed by a boat or other marine vessel to allow the boat to return safely to shore or to its destination after sustaining damage to the hull which seriously destroys the water-tight integrity of the vessel. Specifically, the invention provides a flexible, water-tight cover which is quickly attachable with a bow noose to the vessel for use when the vessel is moving in order to act as a water-tight barrier to prevent water from being received through the damaged portion of the hull when the safety cover is deployed.

In many boating accidents, especially with small sized vessels which have very little compartmentation to provide sufficient water-tight integrity, oftentimes the vessel can strike shoals, rocks, or the hard sea floor and sustain substantial damage to the hull. It is not uncommon for a vessel in rough seas to sustain holes in the hull which would, without water-tight compartmentation, result in the sinking of the vessel. Oftentimes, such accidents happen several miles from safety and the personnel in the boat are often lost to drowning or exposure before they can be found. This type of accident can happen even though the power unit or the motor of the vessel has sustained no damage. Movement of the vessel with a crack or hole in the hull would oftentimes increase the flooding, making that an impractical solution.

The present invention provides a solution to the problem presented to the boatsman whose vessel sustains sufficient hull damage to allow water leakage into the boat by providing a portable, easily stowed, quickly deployable, flexible water-tight hull safety cover which is unrolled and secured at one end to the bow of the vessel, readily positioned under the hull and affixed to the vessel sides. When the cover is secured, the vessel can be safely driven forward, the damaged portion of the hull remaining covered as long as the vessel is kept in motion. The safety cover includes a flexible, water-proof sheet shaped to conform to the hull shape of the vessel, a bow attaching ring or noose disposed at one end of the sheet for affixing one end of the cover to the bow and a plurality of attaching apertures disposed along the lateral sides of the cover for attaching the lateral sides of the cover to the gunnels or sides of the vessel. When used with a vessel having an inboard motor and shaft protruding through the hull, a rigid support member is affixed to the stern end of the cover adjacent a large aperture in the cover. The cover is sized so that, when deployed, the peripheral edges of the cover will be disposed approximately one foot above the water line of the vessel. Utilizing the instant invention, a vessel which has sustained hull damage can be propelled back to a safe harbor or area for the pick-up of the personnel aboard.

BRIEF DESCRIPTION OF THE INVENTION

A portable, flexible, water-tight safety cover for use with a boat or marine vessel having a damaged hull to prevent water from leaking into the vessel while the vessel is moving. The safety cover is constructed of a tough water-proof plastic material such as polypropylene and includes a flexible line formed as a ring or knotted noose connected at one end of the sheet of material which attaches over the bow of the vessel. The bow noose is attachable to a cleat on the vessel bow to allow the front edge of the protective cover to be readily and firmly fastened to the bow of the vessel. The forward edges of the cover are tapered to accomodate and conform to the bow hull area of the vessel, while the rear portion may be rectangularly shaped. A plurality of line receiving apertures are spaced along the lateral edges of the cover, each of which receives a separate line for firmly attaching the cover to the sides of the vessel. The rear apertures have lines of extra length that are used to deploy and guide the cover rearwardly from the bow area. With an inboard motor, a rigid bar is used in one embodiment at the rear end of the cover in addition to an aperture in the cover to allow an inboard motor shaft and propeller to be utilized.

To employ the instant invention, the flexible cover is attached with the bow noose to opposite sides of the bow and unrolled over the bow as the vessel moves forward. The sides of the cover, as it unrolls under the hull, are attached by securing lines to cleats on the vessel sides. The cover extra length stern lines are walked aft deploying the cover beneath the hull. The cover is rapidly disposed under the boat by moving the vessel forward over the cover as the rear of the cover is walked aft. The securing lines are kept such that the lateral sides and stern portion of the safety cover may then be readily attached to the sides and stern as the cover is deployed beneath the boat.

When using the cover with an inboard motor type boat which has a shaft and propeller mounted through the hull bottom or stern, a large aperture or cutout area is provided in the cover so that the cover does not engage the propeller or drive shaft. In this embodiment, the stern end of the cover is not secured to the vessel stern, but remains in the water, with a rigid bar used to stabilize the cover end in the water.

For vessels having an enlarged, deep hull, a weight is used with the cover to prevent fouling on the hull during deployment.

It is an object of this invention to provide a safety cover for the hull of a vessel to prevent water from leaking into the vessel and to keep the vessel afloat after it has sustained hull damage.

It is another object of this invention to provide a portable, quickly deployable safety cover to allow the personnel in the boat to reach safety after a boat has sustained hull damage from rocks, shoals, or the like by allowing a moving vessel to be propelled with a hole in its hull.

And yet still anoter object of this invention is to provide a safety cover for a boat or marine vessel which may be used auxiliarily for maintenance and cleaning of the hull and removal of barnacles.

And yet still another object of this invention is to provide a water-tight disposable cover that may be easily and conveniently stored aboard the vessel when not in use and which is adapted for quick deployment in an emergency situation to allow the boat to be propelled to other areas even after sustaining hull damage.

BRIEF DESCRIPTION OF THE DRAWINGS

FIG. 2 shows a perspective view of the instant invention as it is deployed on a marine vessel.

FIG. 3 shows a top plan view of an alternate embodiment of the instant invention which may be utilized with vessels having an inboard motor with a drive shaft and propeller disposed through the hull beneath the stern.

FIG. 4 shows a side elevational veiw, partially in cross section, of the cover and stern bar connector in accordance with alternate embodiment shown in FIG. 3.

FIG. 5 shows the bow attaching noose connected to the forward end of the cover.

FIG. 6 shows an alternate embodiment of the instant invention for vessels having deep keels.

PREFERRED EMBODIMENT OF THE INVENTION

Figure 1:
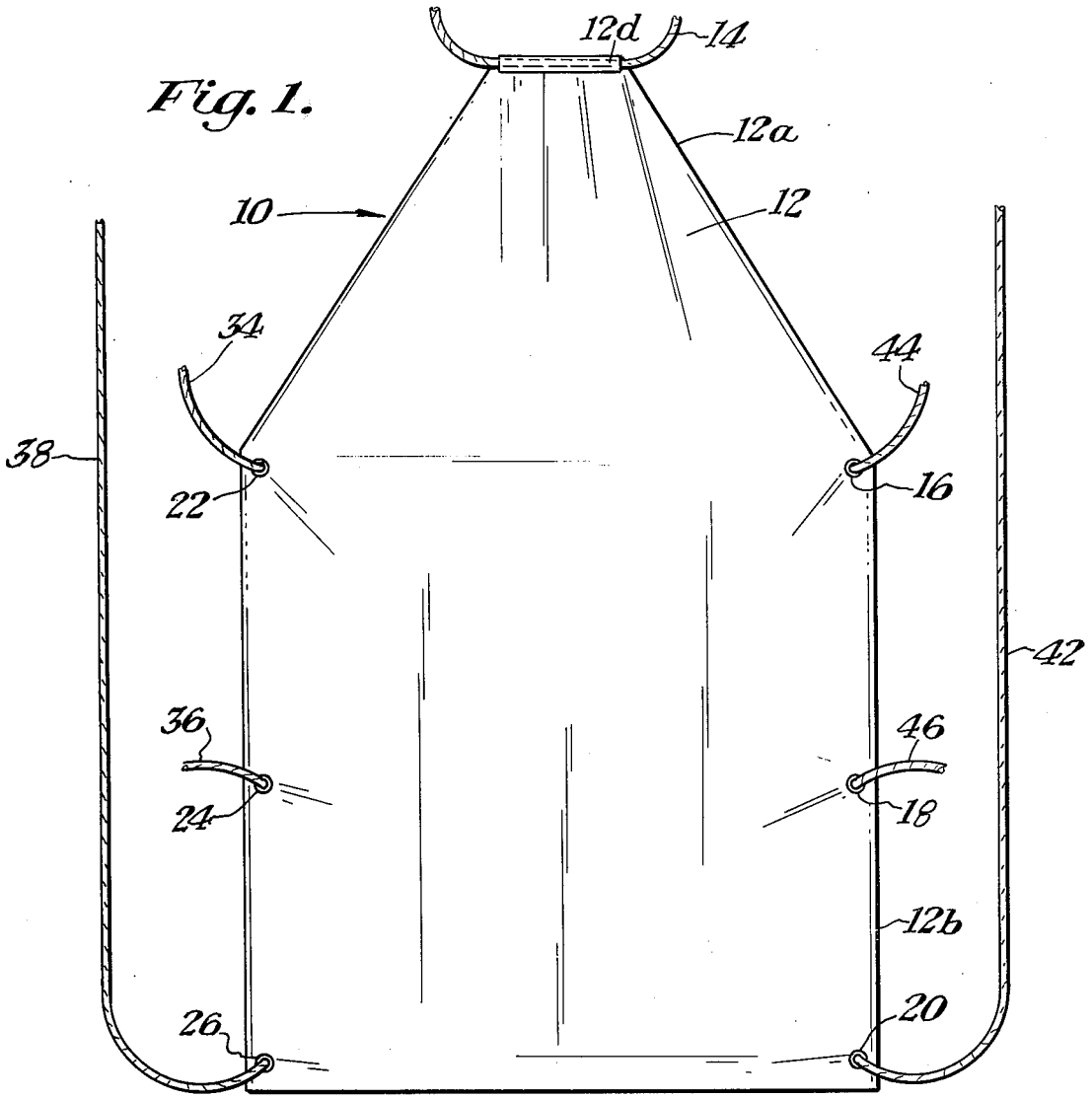
FIG. 1 shows a top plan view of one embodiment of the instant invention.
Figure 1A:
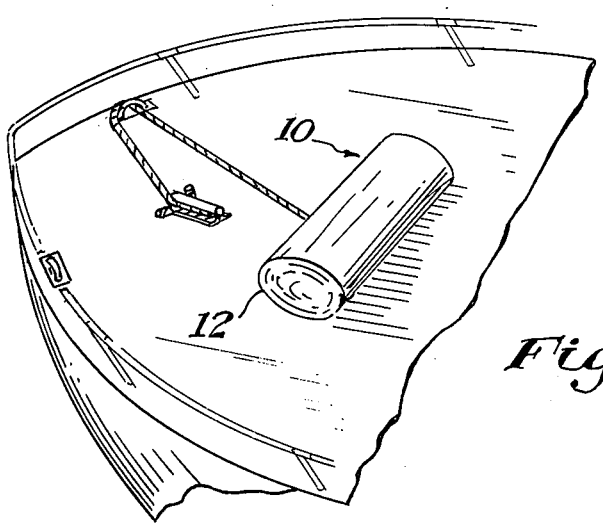
FIG. 1*a* shows a perspective view of the instant invention in a folded configuration as stowed on a vessel bow.

Referring now to the drawings and specifically FIG. 1 the instant invention is shown generally at 10 comprised of a flexible, polypropylene sheet having a substantially rectangular portion **12*b* and a forward tapered portion 12*a* which terminates in the forward end 12*d*. Disposed along the lateral side edges of the cover 12 are a plurality of rope receiving eyes 16, 18, 20, 22, 24 and 26. Disposed through the eyes are connecting lines or rope 34, 36, 38, 42, 44 and 46 which are used to affix the sides of the cover to the sides of a vessel. Connected to the forward end 12*d* of the cover is a rope or flexible line 14 formed in a loop which is attached to the vessel bow. The rope 14 is received through guides 48 (FIG. 5) on the vessel bow and secured to a bow cleat 28. The rope is firmly affixed to the forward end 12*d* of the cover through a loop in the cover end. It is essential that line 14** be firmly fastened to the cover since, when the boat is moving through the water, the line is engaged over the bow, holding the cover to the vessel.

The stern lines 38 and 42 are sized in length to approximate the boat length so that when the cover is being deployed at the vessel bow, the stern lines are walked aft to expedite and insure deployment under the keel. The embodiment of FIG. 1 is used with outboard or inboard-outboard motor drives.

FIG. **1*a*** shows the cover rolled, folded and stowed on the bow of the vessel when not in use. Additional hold down straps may be used to secure the cover to the bow.

FIG. 2 shows the cover 12 deployed on a vessel or a boat 40 which has sustained hull damage such as an aperture 42 in the hull. The forward line 14 is attached to cleat 28 through guides 48 on the bow such that the front edge **12*d* rides well above the water line, as does the front tapered and side edges when connected to the vessel. The cover is shown attached to the sides of the vessel with the eyes 22, 24 and 26 having lines 34, 36 and 38 attached to cleats 46 disposed along the upper surface of the vessel. The boat 40 is propelled forward, pressing the cover against the hull forcing any water between the hull and cover out the stern end while preventing water from being received through the hull aperture 42. In this deployment of the device, as long as the boat is moving, the hull cover 12** will prevent any water from seeping or leaking through the hull of the vessel.

FIG. 3 shows an alternate embodiment of the invention which includes a cover aperture 44 which allows the use of the instant invention with an inboard type of motor and drive train which has a shaft and propeller disposed through the hull beneath the stern that would otherwise interfere with a solid cover. The aperture 44 may be formed by overlapped edge **44*a*** for reinforcing the area around the aperture in which the material is doubled over and affixed to itself to form a stronger aperture perimeter.

The stern edge of the cover 12 includes an end rolled edge **12*c* which houses a rope 32 and a rigid hollow tube 30 which is sized to the approximate beam or width of the boat. The rope 32 is used to guide the back portion of the cover 12 to the stern. The tube 30 allows the cover to have some rigidity while still allowing the side portions and the end portion to be flexibly contoured to fit the particular vessel. The tube 30 also provides a storage support so that the entire cover may be rolled when not in use and unrolled during deployment. In this embodiment the stern end remains in the water during operation. FIG. 4 shows the stern connection with the folded over portion 12*c* of the cover having a rigid tube 30 which has the rope 32 for connecting to the stern disposed therethrough. The rigid tube 30 is constructed in length such that it does not exceed the beam width of the boat. The tube 30** keeps the cover flat and extended in the water with the vessel moving forward.

FIG. 5 shows the bow line 14 connected over the vessel bow **40*a* through guides 48 and connected to cleat 28 to retain the cover 12** against the hull.

FIG. 6 shows another embodiment of the invention using a weight 50 connected to the stern end of cover 12' for use with a deep draft vessel 40'. The weight 50 aids in deploying the cover 12' by forcing the stern end of the cover below the hull. Elongated stern lines are used to guide and secure the stern end of the cover 12' to the vessel 40' after the cover 12' has cleared the bottom of the hull. The weight 50 is secured to the cover by a line.

The particular size and shape of a particular cover will be such that it may be adapted to fit the hull shape of a particular vessel. It is essential that the front bow connector be rigidly attached to the front edge of the cover.

In the preferred embodiment, the cover material may be polypropylene or other, strong yet flexible material which is waterproof and will not become soaked or laden with water when exposed to a marine environment. To deploy the device, once it has been determined that the vessel could be damaged or has struck an object in the water, the cover as rolled would then be moved to the bow of the vessel with the noose or rope attached around and over the bow and the remaining portion of the cover unfurled beneath the forward part. The stern lines are held in hand and walked aft pulling the cover and deploying it under the boat. The boat could be propelled slightly forward to aid in covering the hull. The side lines and the stern lines are then affixed to the vessel such that the safety cover is firmly attached around all sides of the vessel. At this time the vessel may be propelled forward to seek safety for the personnel and boat while the cover, especially as the boat moves, will force water away from the stern and act as a safety hull until its destination is achieved.

The cover may also be used on a moored vessel to protect the hull from barnacles, marine growths and the like by securing the cover completely around the hull.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A safety cover for deployment with a marine vessel which has sustained hull damage to prevent water damage from leaking into the vessel allowing the vessel to be moved with hull damage to a safe location comprising:

a flexible, waterproof thin sheet, said sheet being shaped and sized to cover the hull of a vessel, said sheet having a forward edge having a connector portion for receiving a rope or line;

a plurality of fastening means disposed along the edges and connected to said cover for attaching the cover to the hull of a vessel;

a boat stern end fastening means connected to the end edge portion of said flexible sheet;

a pair of elongated lines connected to the stern end portion of the cover, said lines being sized to be substantially the length of a particular vessel; and said sheet having a large, reinforced aperture disposed adjacent the stern end of the sheet for receiving the drive shaft of the propeller.

2. The device as in claim 1, including:

a rigid tube sized for the approximate beam of a boat to be fitted thereto, said tube being connected to the back edge of said flexible sheet; and, a flexible line disposed between said tube and said sheet back edge for connecting said back edge portion to said stern of the vessel.

3. A safety cover as in claim 2, including:

a weight secured to the stern end of said cover for deploying said cover under a deep draft vessel.

* * * * *